US008387162B2

(12) United States Patent
Huh

(10) Patent No.: US 8,387,162 B2
(45) Date of Patent: Mar. 5, 2013

(54) HINGE COUPLING STRUCTURE FOR WELDING MASK, FACE SHIELD AND SAFETY HELMET

(75) Inventor: Moon Young Huh, Seoul (KR)

(73) Assignee: Otos Wing Co., Ltd. (KR)

( * ) Notice: Subject to any disclaimer, the term of this patent is extended or adjusted under 35 U.S.C. 154(b) by 31 days.

(21) Appl. No.: 13/149,317

(22) Filed: May 31, 2011

(65) Prior Publication Data

US 2012/0144567 A1 Jun. 14, 2012

(30) Foreign Application Priority Data

Dec. 13, 2010 (KR) ..... 10-2010-126859

(51) Int. Cl.

| | |
|---|---|
| ***A61F 9/06*** | (2006.01) |
| ***A61F 9/00*** | (2006.01) |
| ***A42B 1/00*** | (2006.01) |
| ***A42B 1/08*** | (2006.01) |

(52) U.S. Cl. ..... 2/8.2; 2/7; 2/424

(58) Field of Classification Search ..... 2/7, 8.1, 2/8.2, 416, 452, 9, 424, 425, 6.6, 422; 403/84, 403/87, 91, 97, 101, 103, 104, 108

See application file for complete search history.

(56) References Cited

U.S. PATENT DOCUMENTS

| | | | | |
|---|---|---|---|---|
| 2,283,120 | A * | 5/1942 | Malcom | 2/8.1 |
| 2,390,006 | A * | 11/1945 | Severy | 2/8.1 |
| 2,658,200 | A * | 11/1953 | Bowers, Sr. | 2/8.1 |
| 2,788,558 | A * | 4/1957 | Bowers, Jr. | 24/669 |
| 2,926,357 | A * | 3/1960 | Edwards et al. | 2/8.1 |
| 3,074,072 | A * | 1/1963 | Edwards et al. | 2/8.1 |
| 3,075,201 | A * | 1/1963 | Lindblom | 2/8.1 |
| 3,430,262 | A * | 3/1969 | Raschke | 2/8.1 |
| 3,430,263 | A * | 3/1969 | Newcomb | 2/8.1 |
| 4,124,902 | A * | 11/1978 | Seres et al. | 2/10 |
| 4,464,800 | A * | 8/1984 | Edwards | 2/452 |
| 4,536,892 | A * | 8/1985 | Brinkhoff et al. | 2/424 |
| 5,571,217 | A * | 11/1996 | Del Bon et al. | 2/9 |
| 6,260,197 | B1 * | 7/2001 | Hoogewind | 2/8.3 |
| 7,193,783 | B2 * | 3/2007 | Willey et al. | 359/630 |
| 7,409,723 | B2 * | 8/2008 | Huh | 2/8.2 |
| 7,865,968 | B2 * | 1/2011 | Lilenthal et al. | 2/8.2 |
| 8,161,576 | B2 * | 4/2012 | Lemke et al. | 2/418 |
| 8,214,920 | B1 * | 7/2012 | Edgar et al. | 2/8.2 |
| 2006/0080761 | A1 * | 4/2006 | Huh | 2/424 |
| 2007/0245466 | A1 * | 10/2007 | Lilenthal et al. | 2/416 |
| 2007/0245467 | A1 * | 10/2007 | Lilenthal et al. | 2/416 |
| 2008/0184451 | A1 * | 8/2008 | Lemke et al. | 2/8.2 |
| 2010/0212058 | A1 * | 8/2010 | Wanhainen | 2/8.2 |
| 2010/0223707 | A1 * | 9/2010 | Moyses | 2/8.2 |
| 2011/0302701 | A1 * | 12/2011 | Kuo | 2/421 |

* cited by examiner

*Primary Examiner* — Amber Anderson
(74) *Attorney, Agent, or Firm* — Cantor Colburn LLP

(57) ABSTRACT

Disclosed is a hinge coupling structure usable with a welding mask, a face shield or a safety helmet, which serves to connect either side of a protective mask, configured to cover a welder's face along with a viewing window, to a corresponding end of a head band used to assist a welder in wearing the protective mask. The hinge coupling structure includes a rail longitudinally provided at the head band, a slider coupled to the rail so as to be moved forward or rearward in a longitudinal direction of the rail, and a hinge unit coupled to the protective mask while being coupled to the slider interposed therebetween. The hinge coupling structures enables distance adjustment between the protective mask and the welder's face in a state in which the head band is worn on the head, which provides more convenient wearing of the protective mask.

5 Claims, 12 Drawing Sheets

HINGE COUPLING STRUCTURE FOR WELDING MASK, FACE SHIELD AND SAFETY HELMET

BACKGROUND OF THE INVENTION

1. Field of the Invention

The present invention relates to a hinge coupling structure to couple either end of a head band to a left or right end of a protective mask constituting a welding mask, a face shield or a safety helmet.

2. Description of the Related Art

Research and developments to assist a user to conveniently and efficiently use protective equipment, such as a welding mask, a face shield or a safety helmet, have been performed. In particular, interest in a fixing unit (i.e. a hinge coupling structure) to be coupled to a connector is increasing.

In one example, a welding operation generates a strong flash of light and causes a welding material to be scattered toward a welder's face due to sudden heat generated during resistance welding. A welding mask has been used as a representative example of equipment to protect the welder's eyes and face from the aforementioned dangers.

A conventional welding mask generally includes: a protective mask configured to cover a welder's face along with a viewing window; and a head band to assist a welder in wearing the protective mask on the head. Both ends of the head band are coupled to opposite sides of the protective mask using hinge shafts. Thus, in a state in which the head band is worn on the welder's head, the protective mask can be pivotally rotated between the front of the face and the top of the head about the hinge shafts.

SUMMARY OF THE INVENTION

Therefore, the present invention is directed to obviating a problem of the related art in that a head band is simply coupled to a protective mask about hinge shafts in such a way that a distance between the protective mask and a wearer's face cannot be adjusted in a state in which the head band is worn on the head.

It is another object of the present invention to obviate a problem of the related art in that a protective mask has a limited radius of rotation about a head band, which frequently restricts lifting of the protective mask up or down.

In accordance with an aspect of the present invention, the above and other objects can be accomplished by the provision of a hinge coupling structure usable with a welding mask, a face shield or a safety helmet, which serves to connect either side of a protective mask, configured to cover a welder's face along with a viewing window, to a corresponding end of a head band used to assist a welder in wearing the protective mask, the hinge coupling structure including a rail longitudinally provided at the head band, a slider coupled to the rail so as to be moved forward or rearward in a longitudinal direction of the rail, and a hinge unit coupled to the protective mask while being coupled to the slider interposed therebetween.

The rail may include a plurality of distance adjustment recesses equidistantly arranged in the longitudinal direction thereof, and the slider may include buttons protruding from upper and lower ends thereof, and a first stopper configured to be inserted into or separated from a corresponding one of the distance adjustment recesses by operation of the buttons.

The first stopper may be integrally formed at the center of an elastic plate which is bent upon receiving predetermined pressure, and the buttons may take the form of wings integrally formed at upper and lower ends of the elastic plate.

The hinge unit may include a stator centrally provided with a bolt and configured to be coupled with the slider, a rotator rotatably fastened onto the bolt of the stator and configured to penetrate the protective mask to thereby be fixed inside the protective mask, a washer having a central aperture, through which the bolt is fastened, and configured to be key-coupled with the rotator at the outside of the protective mask, and a knob centrally provided with a nut, through which the bolt is fastened.

The stator and the rotator may be respectively provided at facing contact surfaces thereof with anti-rotation protrusions and anti-rotation recesses corresponding to each other, the anti-rotation protrusions and anti-rotation recesses being engaged with each other to prevent rotation of both the stator and the rotator.

The rotator may include a male piece having the anti-rotation recesses, a lever radially extending from a peripheral position thereof and a second stopper protruding from the lever, and a female piece configured to penetrate the protective mask so as to be fixed inside the protective mask and having a plurality of angle adjustment holes into which the second stopper is selectively inserted.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
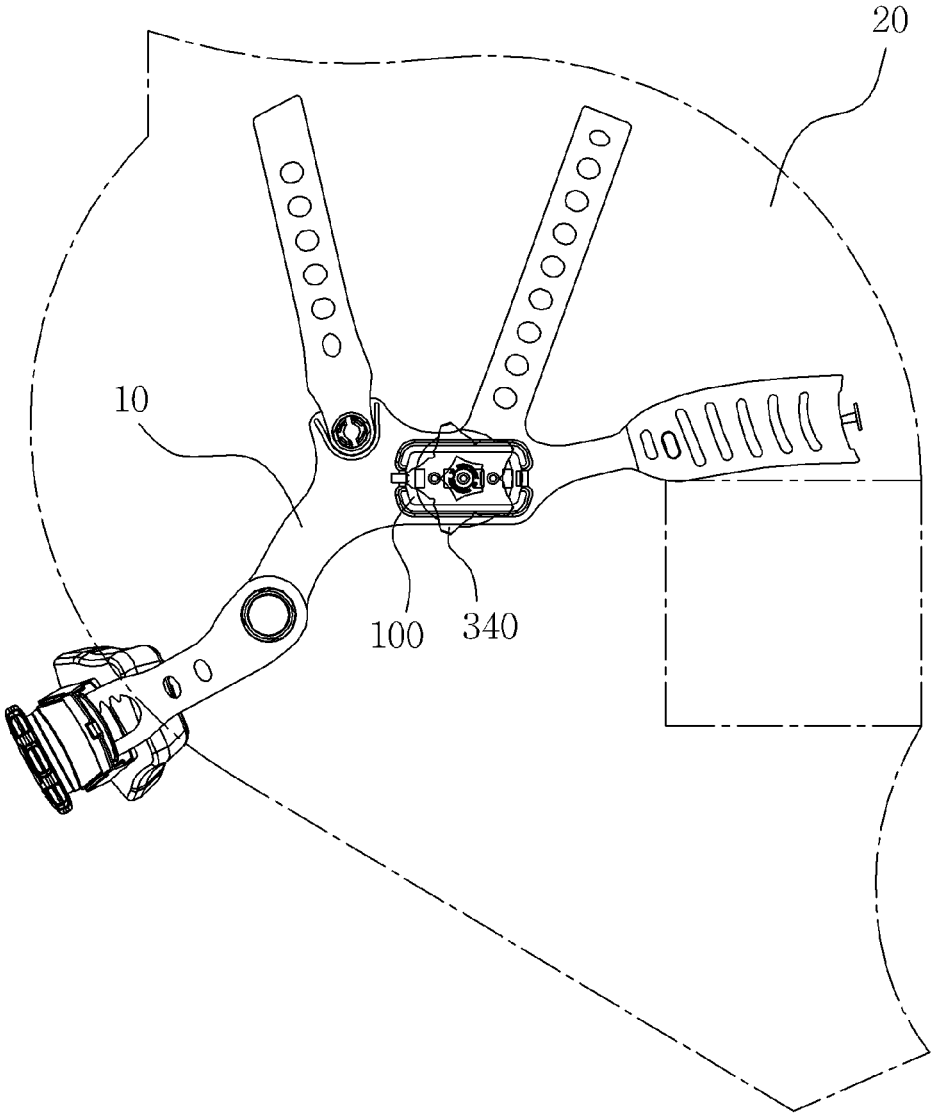
FIG. 1 is a side view illustrating a welding mask in accordance with an embodiment of the present invention.
Figure 2:
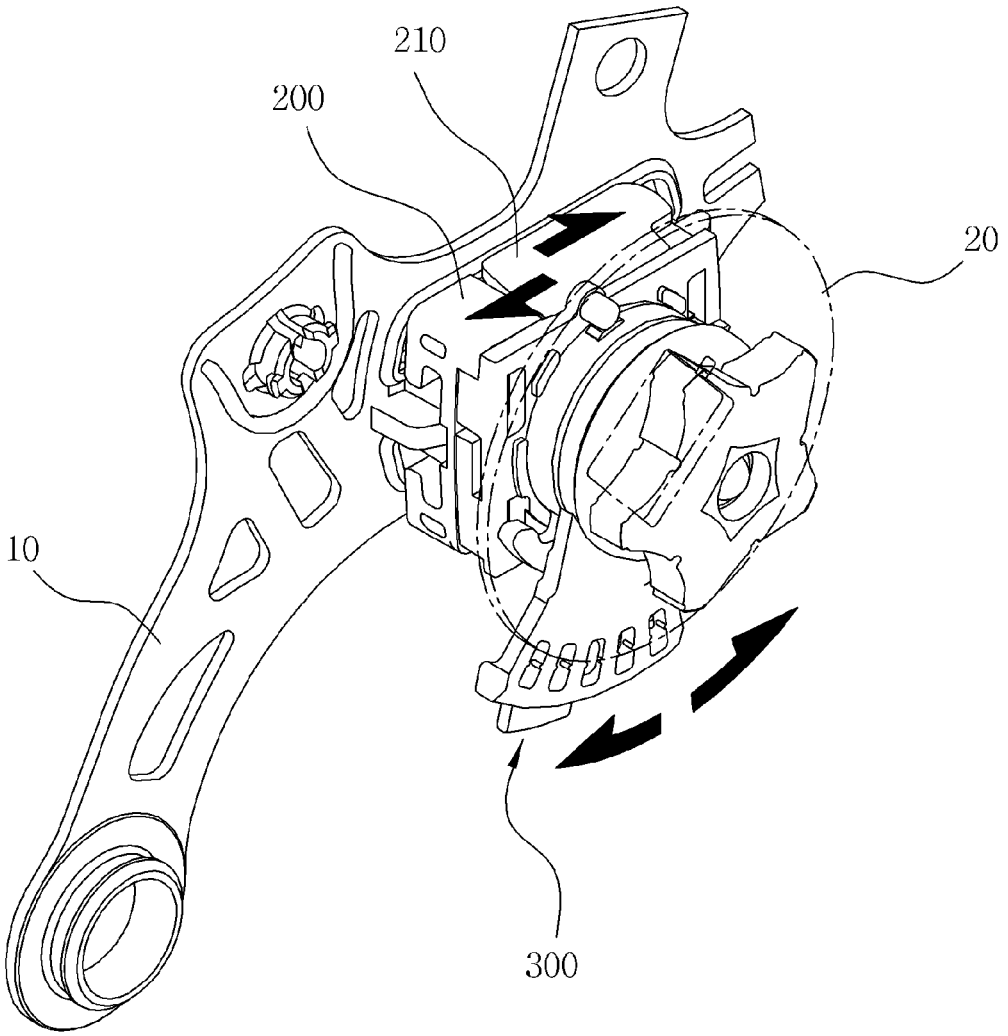
FIG. 2 is a perspective view illustrating main elements of a hinge coupling structure usable with the welding mask in accordance with an embodiment of the present invention.
Figure 3:
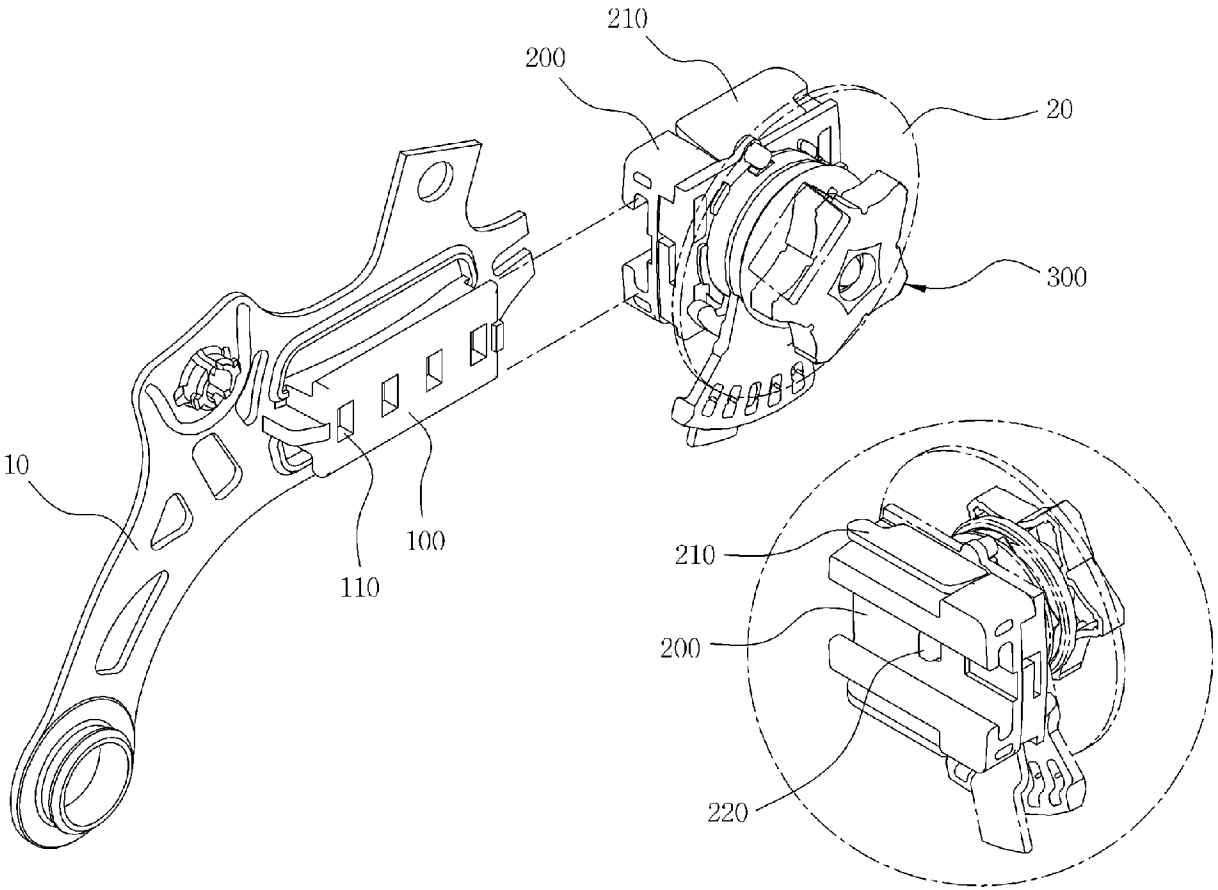
FIG. 3 is an exploded perspective view illustrating a stationary element and a movable element included in the hinge coupling structure usable with the welding mask in accordance with the embodiment of the present invention.

Hereinafter, an exemplary embodiment of the present invention will be described in detail with reference to the accompanying drawings.

Referring to FIGS. 1 to 12 illustrating a hinge coupling structure usable with a welding mask, a face shield or a safety helmet in accordance with the present invention, the hinge coupling structure serves to connect either side of a protective mask 20, which is configured to cover a welder's face along with a viewing window, to a corresponding end of a head band 10, which assists a welder in wearing the protective mask 20. To this end, the hinge coupling structure includes a rail 100 longitudinally mounted to the head band 10, a slider 200 coupled to the rail 100 so as to move forward or rearward in a longitudinal direction of the rail 100, and a hinge unit 300 coupled to the protective mask 20 while being coupled to the slider 200 interposed therebetween.

With the hinge coupling structure having the above described configuration in accordance with the present invention, the slider 200 can be moved forward or rearward by a predetermined distance along the rail 100. As a result, it is possible not only to pivotally rotate the protective mask 20 upward or downward from the head band 10 about the hinge unit 300, but also to forwardly or rearwardly move the protective mask 20 to or from the head band 10 so as to enable simplified adjustment of a distance between the protective mask 20 and a wearer's face.

To this end, there exists the necessity of structures to allow forward or rearward movement of the protective mask 20 and fix the protective mask 20 at a moved position by means of the rail 100 and the slider 200. In the exemplary embodiment, as illustrated in FIGS. 3 and 7 to 9, the rail 100 includes a plurality of distance adjustment recesses equidistantly arranged in the longitudinal direction thereof, and the slider 200 to be coupled with the rail 100 includes buttons 210 provided at upper and lower ends thereof and a first stopper 220 provided at a middle position thereof and configured to be separably inserted into a corresponding one of the distance adjustment recesses 110 by operation of the buttons 210.

Thus, when it is desired to move the slider 200 relative to the rail 100 for the purpose of distance adjustment, the buttons 210 provided at the upper and lower ends of the slider 200 are pushed to allow the first stopper 220 to be separated from the distance adjustment recess 110. Then, after a distance to be adjusted is determined, the buttons 210 are released to allow the first stopper 220 to be inserted into a selected one of the distance adjustment recesses 110 and the slider 200 to be fixed at a moved position.

Figure 4:
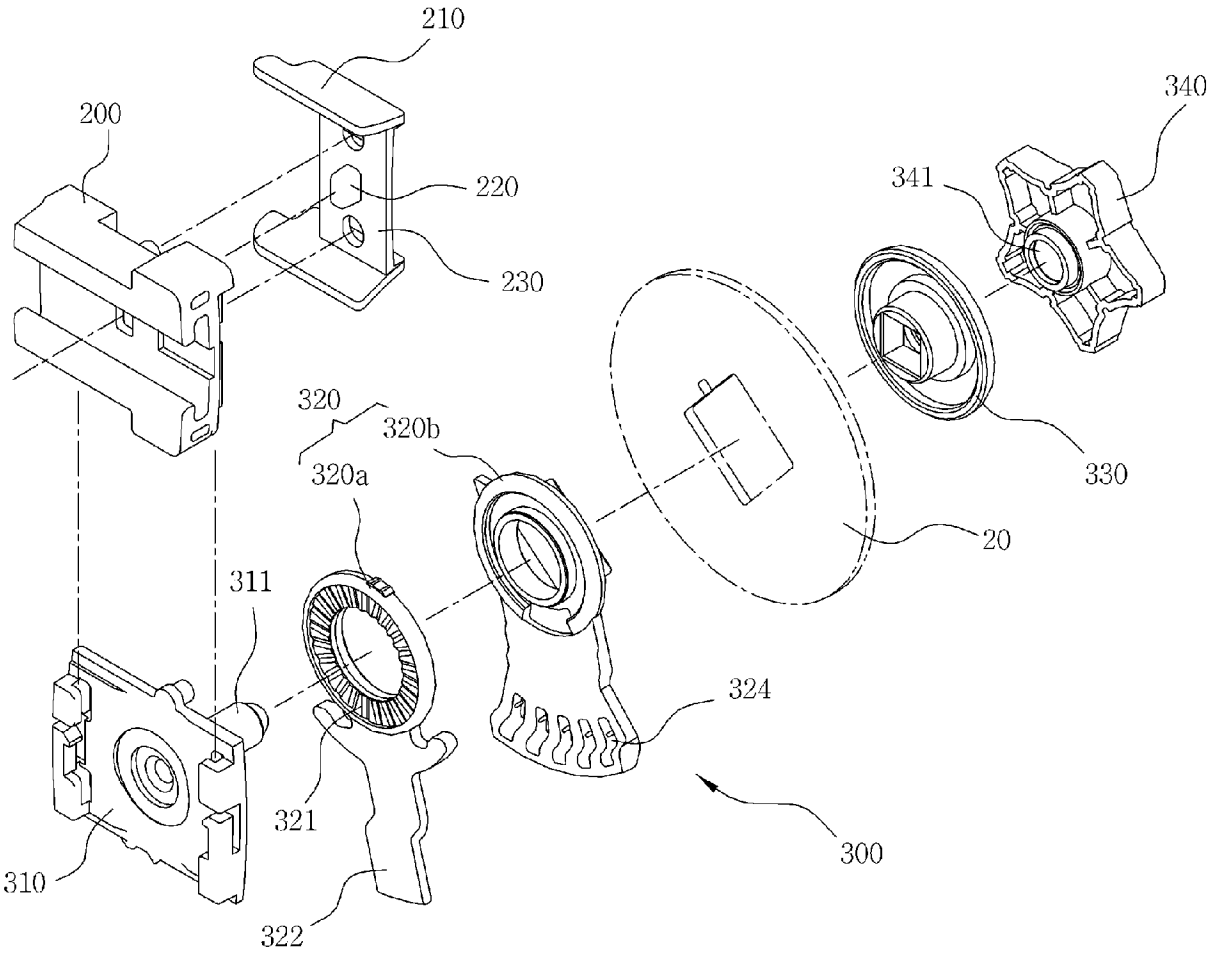
FIGS. 4 and 5 are exploded perspective views illustrating the hinge coupling structure usable with the welding mask in accordance with the embodiment of the present invention.
Figure 5:
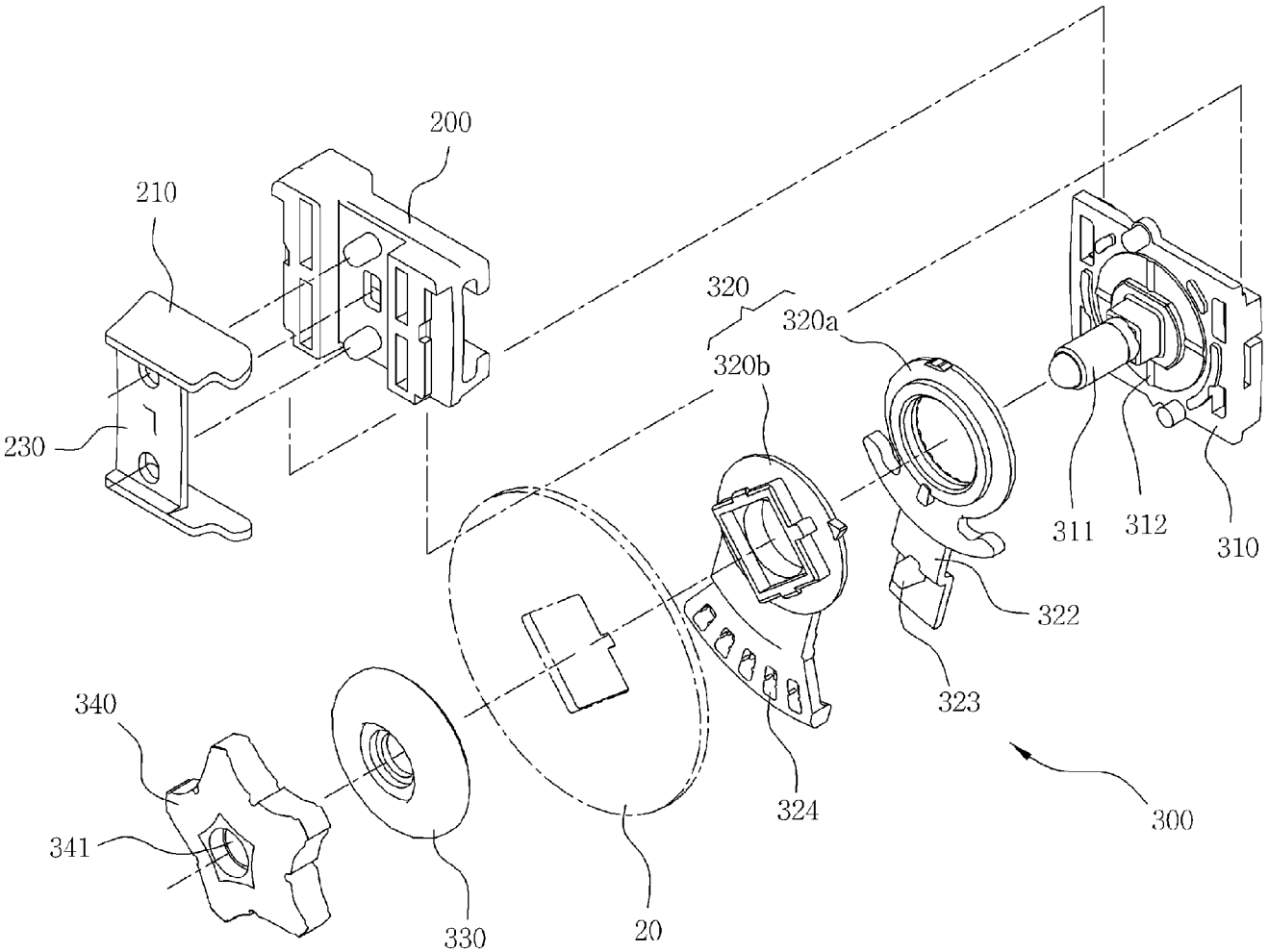
Figure 6:
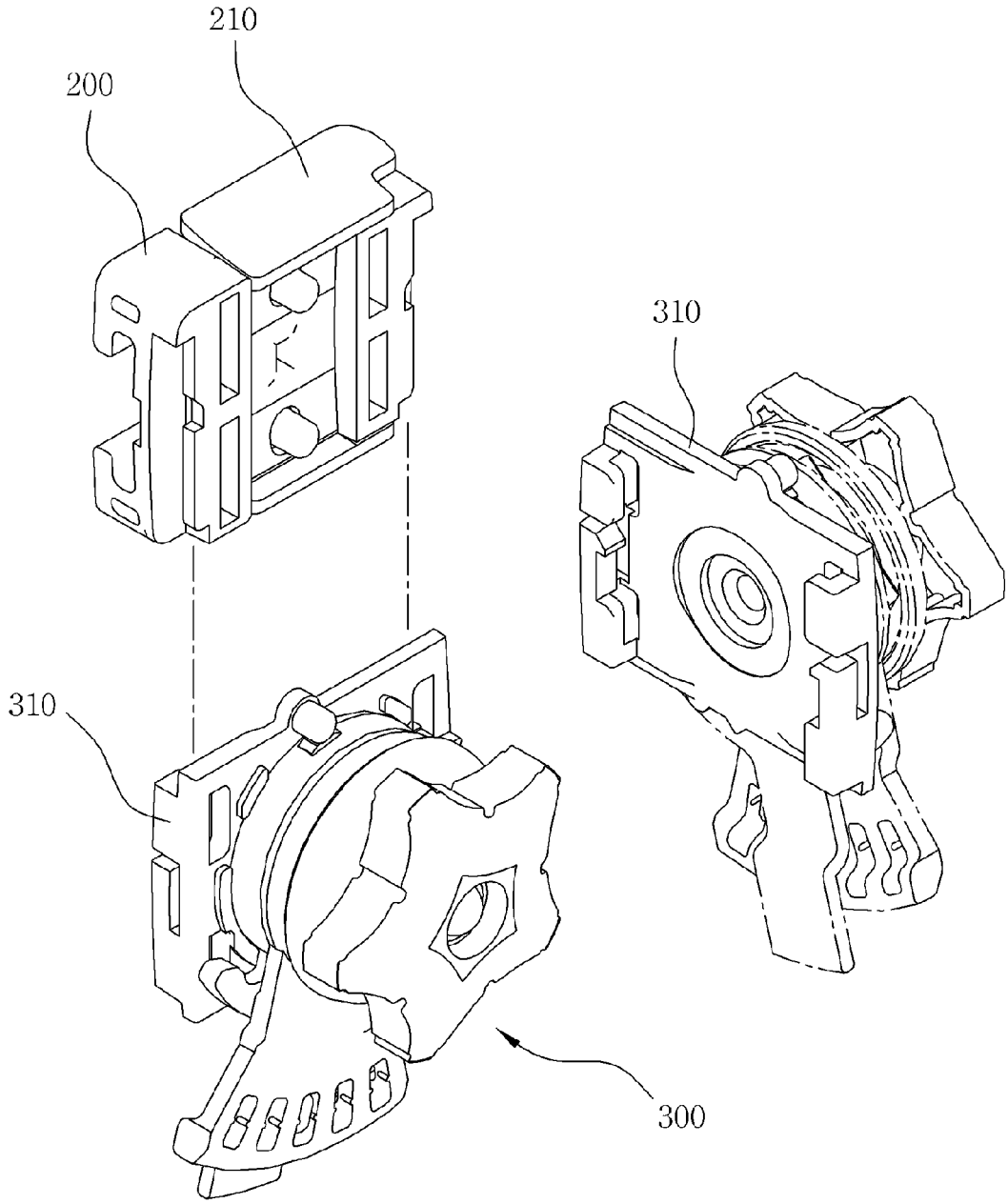
FIG. 6 is an exploded perspective view illustrating the movable element and a rotating element included in the hinge coupling structure usable with the welding mask in accordance with the embodiment of the present invention.
Figure 7:
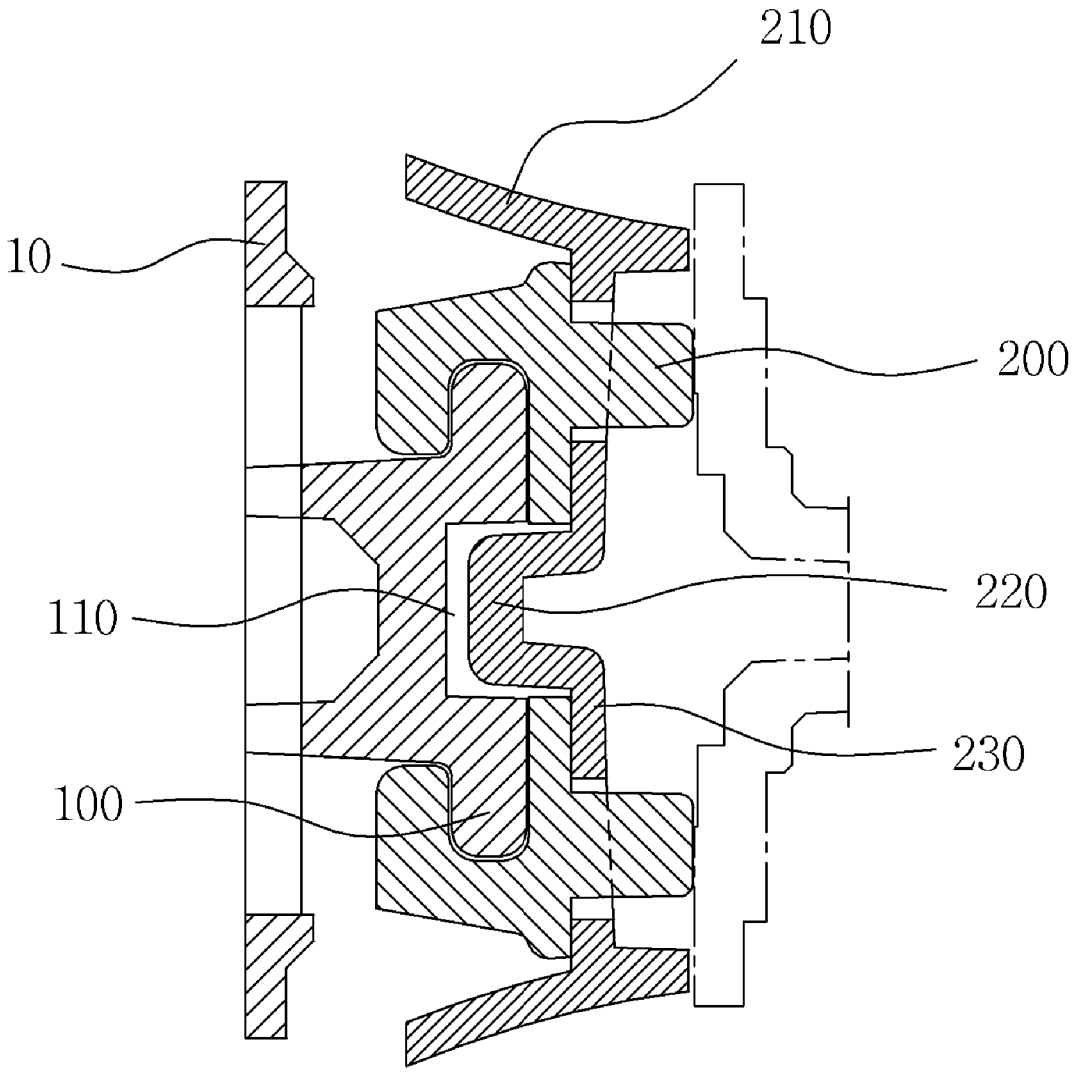
FIGS. 7 to 9 are sectional views illustrating an operational relationship between the stationary element and the movable element included in the hinge coupling structure usable with the welding mask in accordance with the embodiment of the present invention.
Figure 8:
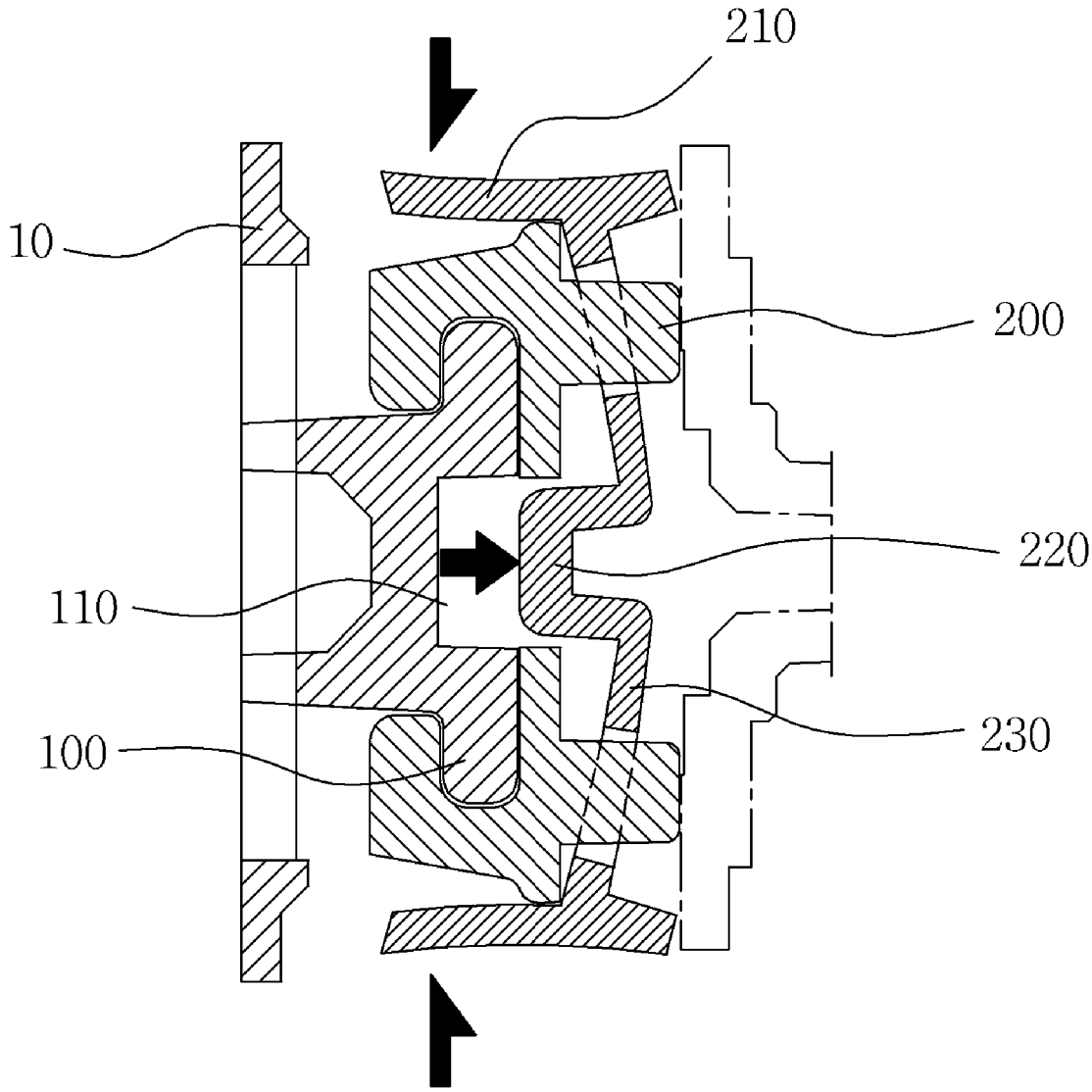
Figure 9:
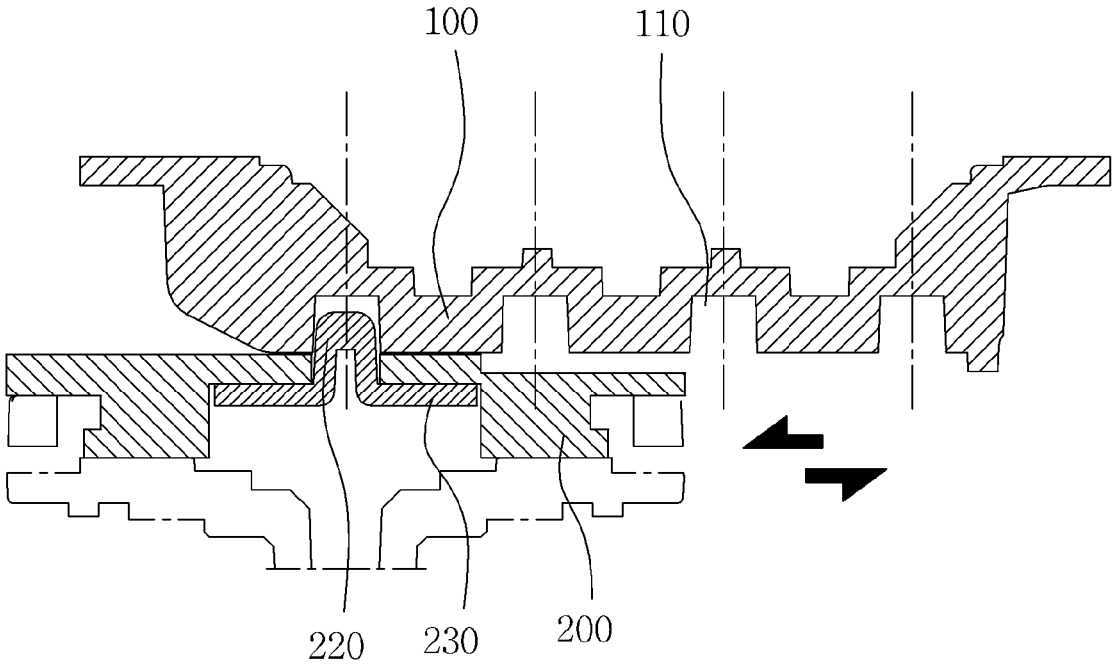
Figure 10:
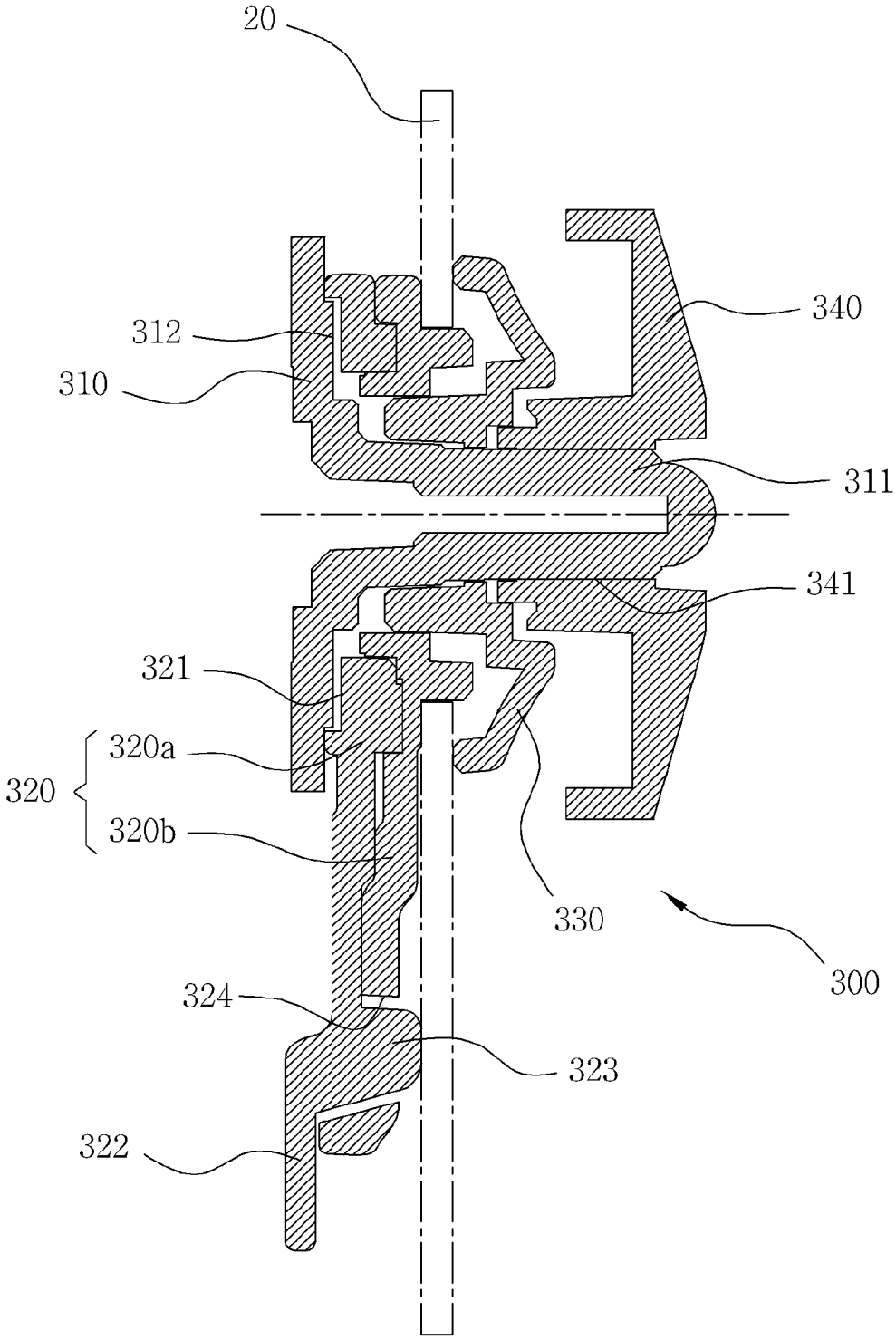
FIGS. 10 to 11 are sectional views illustrating operation of a hinge unit included in the hinge coupling structure usable with the welding mask in accordance with the embodiment of the present invention.
Figure 11:
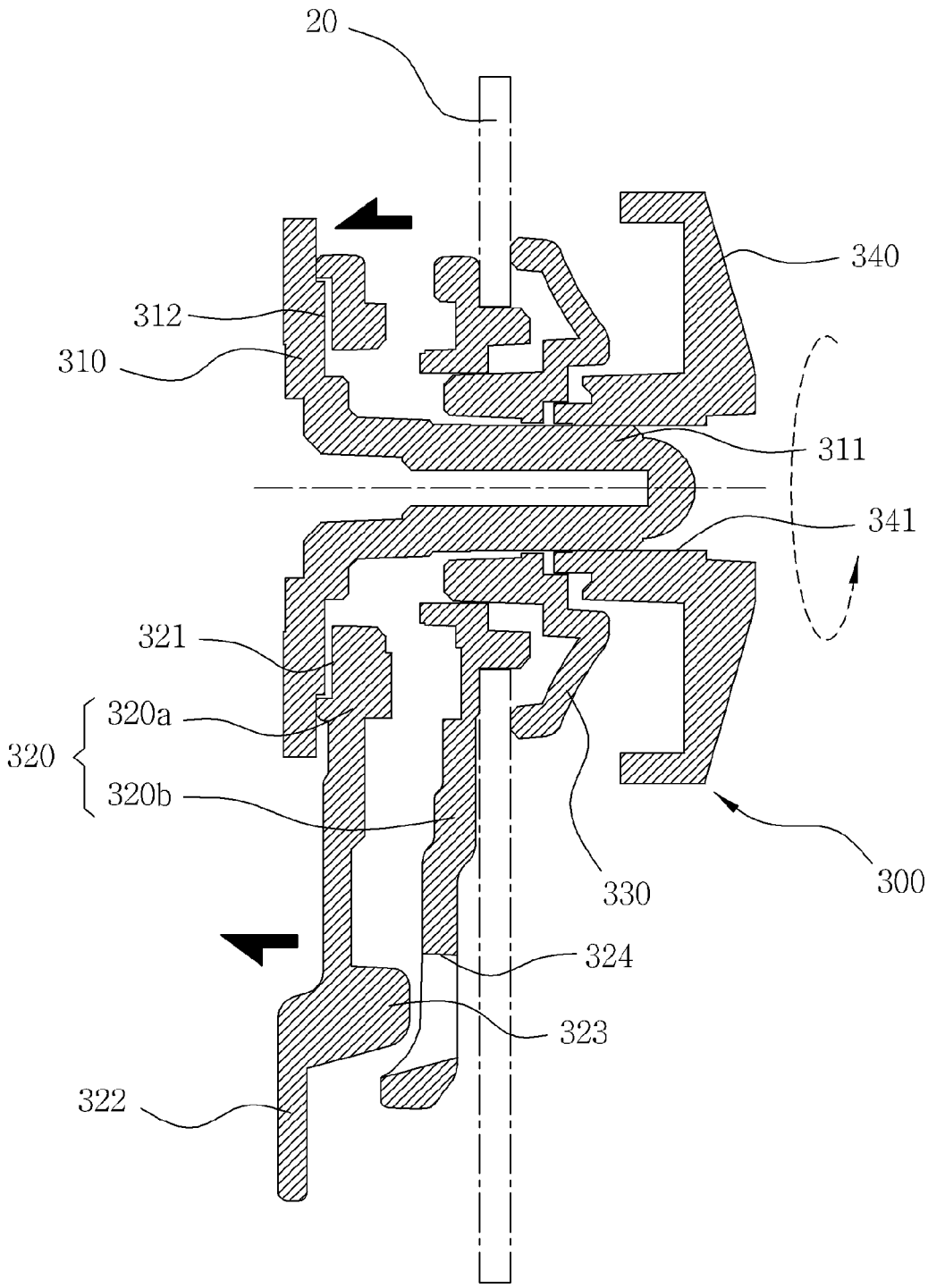
Figure 12:
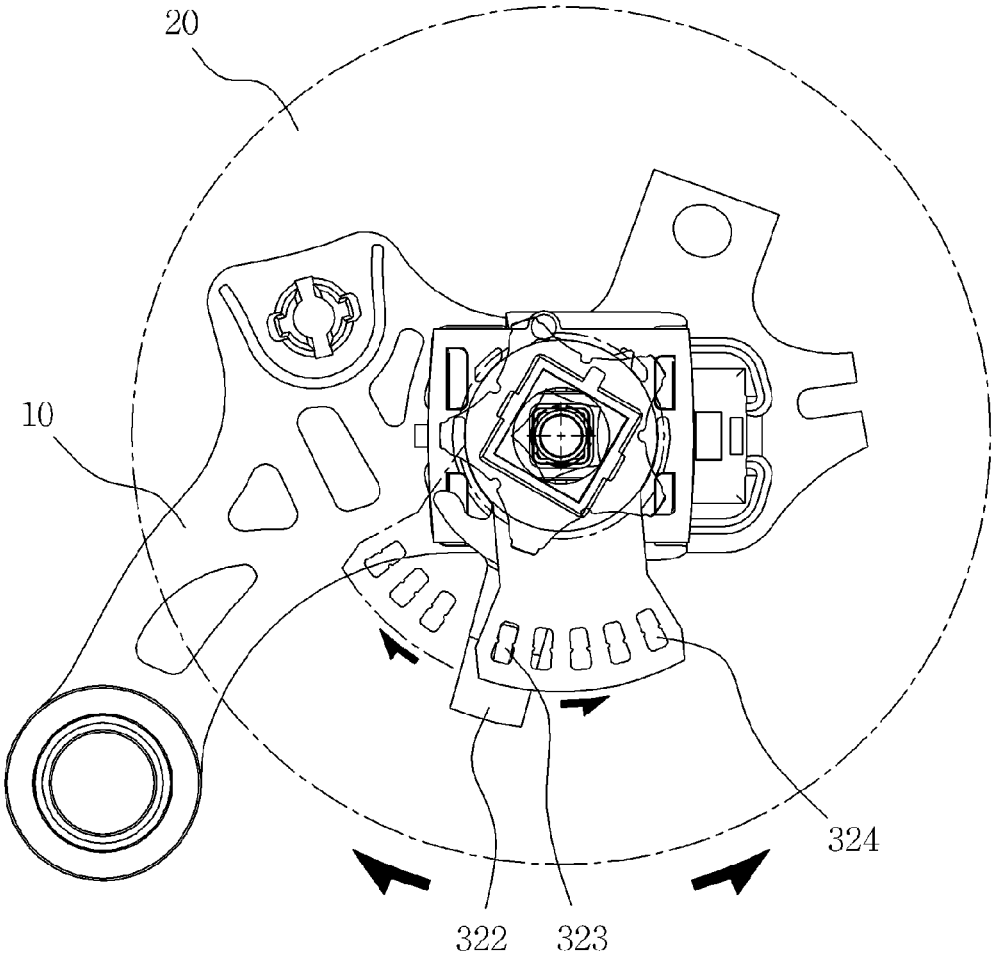
FIG. 12 is a side view illustrating operation of the hinge unit included in the hinge coupling structure usable with the welding mask in accordance with the embodiment of the present invention.

In the embodiment, the buttons 210 and the first stopper 220 may be integrally formed with an elastic plate 230. Specifically, as illustrated in FIGS. 4 and 5, the first stopper 220 is integrally formed at the center of the elastic plate 230, which is bent upon receiving predetermined pressure, and the buttons 210 take the form of wings integrally formed at upper and lower ends of the elastic plate 230. With this configuration, if the buttons 210 are pushed, as illustrated in FIG. 8, a central portion of the elastic plate 230 is bent, causing the first stopper 220 to be separated from the distance adjustment recess 110.

The hinge unit 300 serves to allow the protective mask 20 to be pivotally rotated from the head band 10. In the embodiment, as illustrated in FIGS. 4, 5 and 10 to 12, the hinge unit 300 includes a stator 310, a rotator 320, a washer 330 and a knob 340. The stator 310 is centrally provided with a bolt 311 and is configured to be coupled with the slider 200. The rotator 320 is rotatably fastened onto the bolt 311 of the stator 310 such that a part of the rotator 320 penetrates the protective mask 20 to thereby be fixed inside the protective mask 20. The washer 330 has a central aperture, through which the bolt 311 is fastened, and is configured to be key-coupled with the rotator 320 at the outside of the protective mask 20. The knob 340 is centrally provided with a nut 341 through which the bolt 311 is fastened.

Accordingly, if the knob 340 is tightened such that the rotator 320 comes into close contact with the stator 310, the protective mask 20, through which the rotator 320 penetrates so as to be fixed, is prevented from rotating. Then, if the knob 340 is released such that the rotator 320 is separated from the stator 310, the protective mask 20, through which the rotator 320 penetrates so as to be fixed, can be pivotally rotated upward or downward.

To prevent the protective mask 20 from sliding and unintentionally pivotally rotating by the weight thereof in a state in which the stator 310 and the rotator 320 come into close contact with each other, the stator 310 and the rotator 320 are respectively provided at facing contact surfaces thereof with anti-rotation protrusions 312 and anti-rotation recesses 321, which are engaged with each other to prevent rotation of both the stator 310 and the rotator 320. For example, one to four anti-rotation protrusions 312 are equidistantly arranged around the bolt 311 of the stator 310, and twenty to forty anti-rotation recesses 321 are equidistantly arranged about the center of the rotator 320.

In the embodiment, as illustrated in FIGS. 4 and 5 and 10 to 12, the rotator 320 consists of a male piece 320*a* and a female piece 320*b*. The male piece 320*a* of the rotator 320 is provided with the anti-rotation recesses 321 and includes a lever 322 radially extending outward from a peripheral position thereof, on which a second stopper 323 is formed. The female piece 320*b* of the rotator 320 penetrates the protective mask 20 so as to be fixed inside the protective mask 20 and is provided with a plurality of angle adjustment holes 324 into which the second stopper 323 is selectively inserted.

With provision of the rotator 320 consisting of the male piece 320*a* provided with the second stopper 323 and the female piece 320*b* provided with the angle adjustment holes 324, a pivotal rotation angle of the protective mask 20 can be precisely adjusted by means of the male piece 320*a* and the female piece 320*b*.

For example, if a position of a viewing window is incorrectly aligned with the wearer's eyes or the protective mask 20 does not completely cover the wearer's face when the knob 340 is released to lower the protective mask 20 in a state in which the second stopper 323 is inserted into a first one of the angle adjustment holes 324, the lever 322 of the male piece 320*a* may be pulled to move the second stopper 323 into a second one of the angle adjustment holes 324 so as to change a worn position of the protective mask 20. Here, moving the second stopper 323 from the first one to the second one of the angle adjustment holes 324 means that the protective mask 20 is further lowered. On the contrary, upon judging that the protective mask 20 is excessively lowered, the pivotal rotation angle of the protective mask 20 can be adjusted in the same manner as in the above description, which can assist the wearer in conveniently wearing the protective mask 20.

As is apparent from the above description, in accordance with the exemplary configuration of the present invention, a coupling position of the protective mask 20 with respect to the head band 10 can be displaced forward or rearward. This enables adjustment in a distance between the protective mask 20 and the wearer's face in a state in which the head band 10 is worn on the head, thereby ensuring more convenient wearing of the protective mask 20. Further, as a result of enabling adjustment in the radius of rotation of the protective mask 20 from the head band 10, it is possible to conveniently adjust the height or angle of the viewing window with respect to the eyes when the protective mask 20 is completely lowered and consequently, to more safely protect the wearer's face.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A hinge coupling structure usable with a welding mask, a face shield or a safety helmet, which serves to connect either side of a protective mask, configured to cover a welder's face along with a viewing window, to a corresponding end of a head band used to assist a welder in wearing the protective mask, the hinge coupling structure comprising:

a rail longitudinally provided at the head band;

a slider coupled to the rail so as to be moved forward or rearward in a longitudinal direction of the rail; and a hinge unit coupled to the protective mask while being coupled to the slider interposed therebetween, wherein the hinge unit includes:

a stator centrally provided with a bolt and configured to be coupled with the slider;

a rotator rotatably fastened onto the bolt of the stator and configured to penetrate the protective mask to thereby be fixed inside the protective mask;

a washer having a central aperture, through which the bolt is fastened, and configured to be key-coupled with the rotator at an outside of the protective mask; and a knob centrally provided with a nut, through which the bolt is fastened.

2. The hinge coupling structure according to claim 1, wherein the rail includes a plurality of distance adjustment recesses equidistantly arranged in the longitudinal direction thereof, and wherein the slider includes: buttons protruding from upper and lower ends thereof; and a first stopper configured to be inserted into or separated from a corresponding one of the distance adjustment recesses by operation of the buttons.

3. The hinge coupling structure according to claim 2, wherein the first stopper is integrally formed at a center of an elastic plate which is bent upon receiving predetermined pressure, and the buttons take the form of wings integrally formed at upper and lower ends of the elastic plate.

4. The hinge coupling structure according to claim 1, wherein the stator and the rotator are respectively provided at facing contact surfaces thereof with anti-rotation protrusions and anti-rotation recesses corresponding to each other, the anti-rotation protrusions and anti-rotation recesses being engaged with each other to prevent rotation of both the stator and the rotator.

5. The hinge coupling structure according to claim 4, wherein the rotator includes:

a male piece having the anti-rotation recesses, a lever radially extending from a peripheral position thereof and a second stopper protruding from the lever; and a female piece configured to penetrate the protective mask so as to be fixed inside the protective mask and having a plurality of angle adjustment holes into which the second stopper is selectively inserted.

* * * * *